US005928029A

United States Patent [19]

Lam

[11] Patent Number: 5,928,029

[45] Date of Patent: Jul. 27, 1999

[54] MULTI-PIN CONNECTOR FOR FLAT CABLE

[75] Inventor: Joe Chua Sze Lam, Singapore, Singapore

[73] Assignee: Thomas & Betts Corporation, Memphis, Tenn.

[21] Appl. No.: 09/086,830

[22] Filed: May 29, 1998

[51] Int. Cl.[6] ..... H01R 9/07

[52] U.S. Cl. ..... 439/497; 439/495

[58] Field of Search ..... 439/329, 492, 439/495, 496, 497

[56] References Cited

U.S. PATENT DOCUMENTS

| | | | |
|---|---|---|---|
| 4,367,006 | 1/1983 | Rehbogen, Jr. et al. . | |
| 4,449,773 | 5/1984 | Esser et al. . | |
| 4,477,137 | 10/1984 | Ayer . | |
| 4,592,611 | 6/1986 | Nitschke | 339/91 R |
| 4,640,562 | 2/1987 | Shoemaker . | |
| 4,850,899 | 7/1989 | Maynard . | |
| 4,863,395 | 9/1989 | Babuka et al. . | |
| 5,083,939 | 1/1992 | Ittah | 439/496 |
| 5,100,342 | 3/1992 | Olsson | 439/497 |
| 5,173,058 | 12/1992 | Broeksteeg et al. . | |
| 5,213,534 | 5/1993 | Gardner et al. . | |
| 5,240,430 | 8/1993 | Soes . | |
| 5,354,214 | 10/1994 | Aso et al. | 439/492 |
| 5,370,552 | 12/1994 | Chishima et al. . | |
| 5,474,468 | 12/1995 | Chishima et al. . | |
| 5,492,486 | 2/1996 | Tanigawa | 439/495 |
| 5,542,855 | 8/1996 | Asai . | |
| 5,549,485 | 8/1996 | Chishima et al. . | |
| 5,562,487 | 10/1996 | Ii et al. . | |

*Primary Examiner*—Steven L. Stephan
*Assistant Examiner*—Michael C. Zarroli
*Attorney, Agent, or Firm*—Hoffmann & Baron, LLP

[57] ABSTRACT

A low insertion force multi-pin connector for a flat flexible cable includes an insulative housing, conductive terminals mounted in the housing and a slide member which is laterally inserted into the housing to press a flat flexible cable against contact arms of the terminals. The terminals have pin portions which protrude through a header side of the housing. The connector is mounted to an external surface of an electrical device such that the header side of the housing projects outwardly to provide external electrical connection to the pin portions of the terminals.

10 Claims, 7 Drawing Sheets

MULTI-PIN CONNECTOR FOR FLAT CABLE

BACKGROUND OF THE INVENTION

1. Field of the Invention

The present invention relates to electrical connectors for flat cables, and more particularly relates to a low insertion force (LIF) connector for providing an external electrical interface for an internal flat cable of an electrical device.

2. Description of Prior Art

Use of low insertion force (LIF) and zero insertion force (ZIF) connectors on printed circuit boards for receiving a flexible printed circuit (FPC) or a flexible flat cable (FFC) is well known in the field. LIF and ZIF relate to the technology of providing an electrical connector with the means in which conductors are inserted into the connector under relatively friction free and damage free conditions. Such connectors are typically soldered or otherwise affixed to an internal circuit board of an electrical device. An FPC or FFC is inserted into the connector and held in place to ensure positive electrical contact between the conductors of the FPC or FFC and the terminals of the connector. Various means of inserting and holding the FPC or FFC using low or zero insertion force are used to prevent damage to the FPC or FFC or damage to the components of the connector.

For example, U.S. Pat. No. 5,562,487 to Ii et al. discloses an electrical connector having an actuator which is slidably inserted in the connector housing. The actuator has a flat surface portion upon which a flat flexible cable may lie during friction free insertion of the actuator and cable into the housing. Thus inserted, the flexible flat cable makes electrical contact with the terminals of the connector. The terminals include solder tails which extend out of the connector housing which are soldered to a printed circuit board.

Similarly, U.S. Pat. No. 4,640,562 to Shoemaker discloses a surface mounting means for an electrical connector to a printed circuit board which includes a wedge plate for forcing contact of the flexible cable to the terminals of the connector. The connector is releasably mounted to the surface of the circuit board making electrical contact between the terminals and the conductors of the circuit board. These and other LIF and ZIF connectors provide efficient, damage free electrical connection between flexible flat cables or flexible printed circuits and internal circuit boards.

Each of the above described connectors are designed to establish LIF or ZIF interconnection to internal components of an electrical device. However, the use of LIF or ZIF termination technology has not been shown in an external environment. Certain electrical devices, such as personal computers and disk drives, require an external interface for an internal component. A multi-pin connector is typically provided on such devices to connect a flexible flat cable to an external port of the device. FIG. 1 shows a conventional external multi-pin connector 100 for a flat flexible cable 101. The conventional connector 100 is provided with box-pin terminals 102 having solder tails 103 which engage through holes of the flat flexible cable. A strain relief bar 104 is also provided on the connector to hold the cable in place. Once the flat flexible cable 101 is linked to an internal component of the device, such as a printed circuit board or a hard disk actuating arm, the other end of the cable is connected to the external connector by through hole tin-lead soldering. This process tends to be costly and intricate as the soldering operation involves targeting the through holes of the flex cable to the solder tails after passing the cable through the connector's strain relief bar.

Accordingly, it is desirable to provide ZIF or LIF technology to an external connector for a flat flexible cable extending from an internal component which in turn would provide quick and easy connection and disconnection between the flat flexible cable and the external connector.

OBJECTS AND SUMMARY OF THE INVENTION

It is an object of the present invention to provide a multi-pin external connector for a flat flexible cable which utilizes low insertion force technology.

It is another object of the present invention to provide an external multi-pin connector for a flexible flat cable which eliminates the process of soldering the flat cable to the connector.

It is yet another object of the present invention to provide an external multi-pin connector for a flat flexible cable in which the cable is quickly and easily connected and disconnected to the connector.

In accordance with one form of the present invention a low insertion force multi-pin connector for a flat flexible cable generally includes an elongate insulative housing, a plurality of conductive terminals mounted in the housing and an insulative slide member. The insulative housing includes a tail side, a header side, a longitudinal slot disposed on the tail side, a plurality of slits disposed on the tail side and arranged perpendicularly across the longitudinal slot and a plurality of apertures extending from the header side which are in communication with respective slits. The conductive terminals each comprise a pin portion and two contact arms, each contact arm being capable of being outwardly deflected. The terminals are mounted within respective slits of the insulative housing such that the pin portions protrude through the apertures of the header side and the contact arms form generally parallel rows of upper and lower contact arms on the tail side. The insulative slide member is shaped to be inserted, along with the flat flexible cable, into the longitudinal slot of the tail side of the housing. In operation, the flat cable is first inserted into the longitudinal slot of the housing between the upper and lower contact arms. The slide member is then inserted into the longitudinal slot pressing the flat cable against either the upper or lower rows of contact arms thereby making electrical connection between the flat cable and the terminals. The connector is mounted to an external surface of an electrical device such that the header side of the housing projects outwardly to provide external electrical connection to the pin portions of the terminals.

The multi-pin connector may be shaped to provide straight electrical connection or right-angle electrical connection. For straight electrical connection, the terminals are shaped such that the contact arms extend in an opposite direction as the pin portion and the header side and the tail side of the insulative housing are on opposite generally parallel surfaces. In a preferred embodiment of the straight configuration, the terminals are installed within the insulative housing in a configuration in which every other terminal is rotated 180° forming two rows of pin portions protruding through the header side of the insulative housing.

In the right-angle configuration, the terminals are shaped such that the pin portion extends perpendicularly to the contact arms and the header side and tail side of the insulative housing are disposed on perpendicular surfaces. In a preferred embodiment of the right-angle configuration, the terminals are formed in one of two shapes, the first shape having the pin portion extending perpendicularly from a contact arm at an upper location and the second shape having the pin portion extending from the contact arm at a lower location. The terminals are then installed in the housing in alternating shapes forming two rows of pin portions protruding through the header side of the housing. In either the straight or right angle configuration, the pin portions of the terminal are preferably laterally offset from the plane of the contact arms. Preferably, the contact arms also include J-shaped end portions facing inwardly between the contact arms to provide better contact between the terminals and the flat cable.

The slide member preferably includes an upper surface having an inclined portion adapted to bias the flat flexible cable into contact with one of the rows of contact arms when the flat cable and slide member are inserted in the longitudinal slot of the housing. The slide member and the insulative housing also preferably include a cooperating latch and socket mechanism for releasably retaining the slide member in the longitudinal slot of the insulative housing.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

The present invention is designed to permit repetitive interconnection between a flat cable and an electrical connector such as a connector employed in an external environment. The external environment refers to the use of certain electrical devices such as personal computers and disk drives which require external interface for an internal component. Thus, the connector of the present invention permits repetitive connection and disconnection by a user of a flat flexible cable. In order to provide for such repetitive connection and disconnection and to assure proper electrical connection between the flat cable and the terminals of the connector housing each time connection is made, the present invention provides an elongated insulative housing which supports a plurality of conductive terminals. The conductive terminals are of the type including a pin portion and two contact arms arranged in a U-shaped configuration. A flat cable having exposed conductive portions along a single surface thereof is designed to be inserted into the housing between the U-shaped contact arms of the terminals. An insulative slide member is adapted to be inserted into the housing between the U-shaped contact arms of the terminals. The slider urges the exposed conductive portions of the flat cable into electrical engagement with one of the two contact arms while the other of the contact arms maintains elastic urging of the slider and thereby the flat cable into engagement with the one contact arms.

In order to maintain the ability to repetitively connect and disconnect the flat cable from the connector housing and to assure that upon each instance the exposed conductive portions of the flat cable are maintained in electrical engagement with the arms, the present invention provides a flexible spring latch which is integrally formed with the slide member. The deflectable spring latch is engagable with a latch receiving socket on the insulative housing. The interengagement between the spring latch and the latch receiving socket is releasable so that the slide member may be releasably retained by the insulative housing. The release of the latch from the socket provides for a disconnection of the slider from the housing and thereby disconnection of the flat cable from its conductive engagement with the one contact arm. However, while the engagement between the slide member and the insulative housing is releasable, the engagement between the latch and the latch receiving socket assures proper electrical engagement between the exposed conductive portions of the flat cable and the contact arms.

Figure 1:
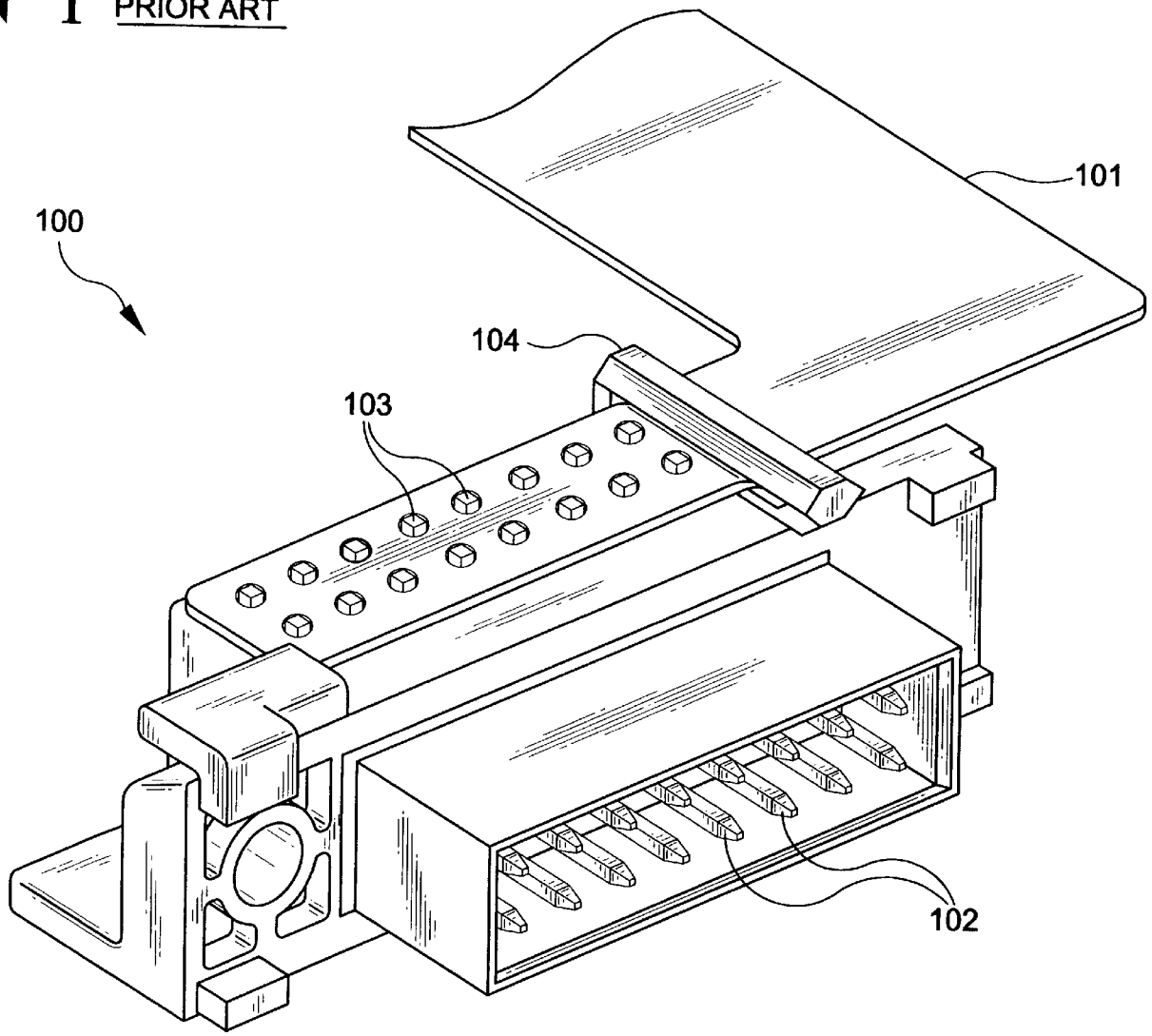
FIG-1 PRIOR ART
FIG. 1 is a perspective view of a prior art multi-pin connector for a flat flexible cable.
Figure 2:
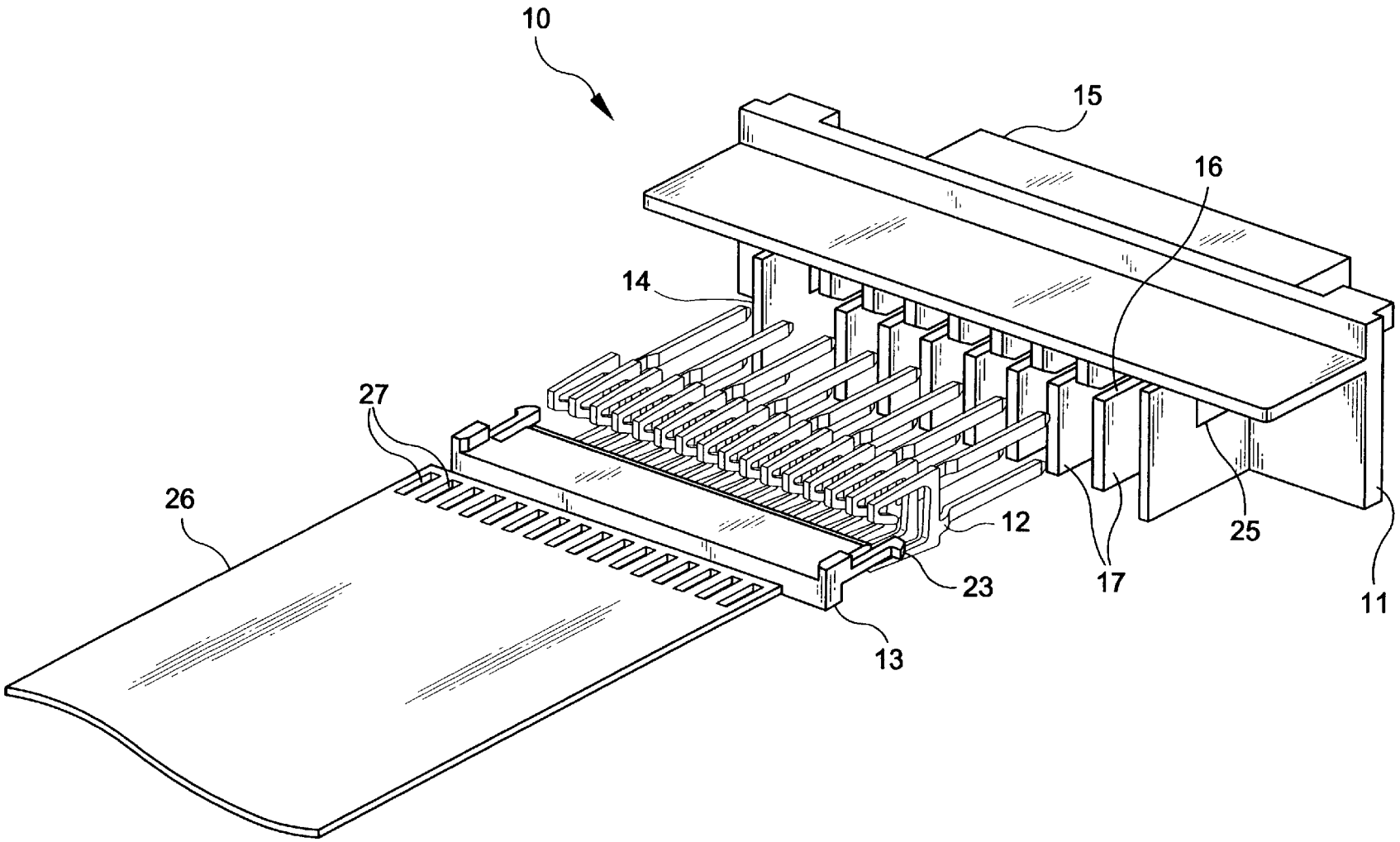
FIG. 2 is an exploded perspective view of the multi-pin connector for a flat flexible cable according to the present invention.
Figure 3:
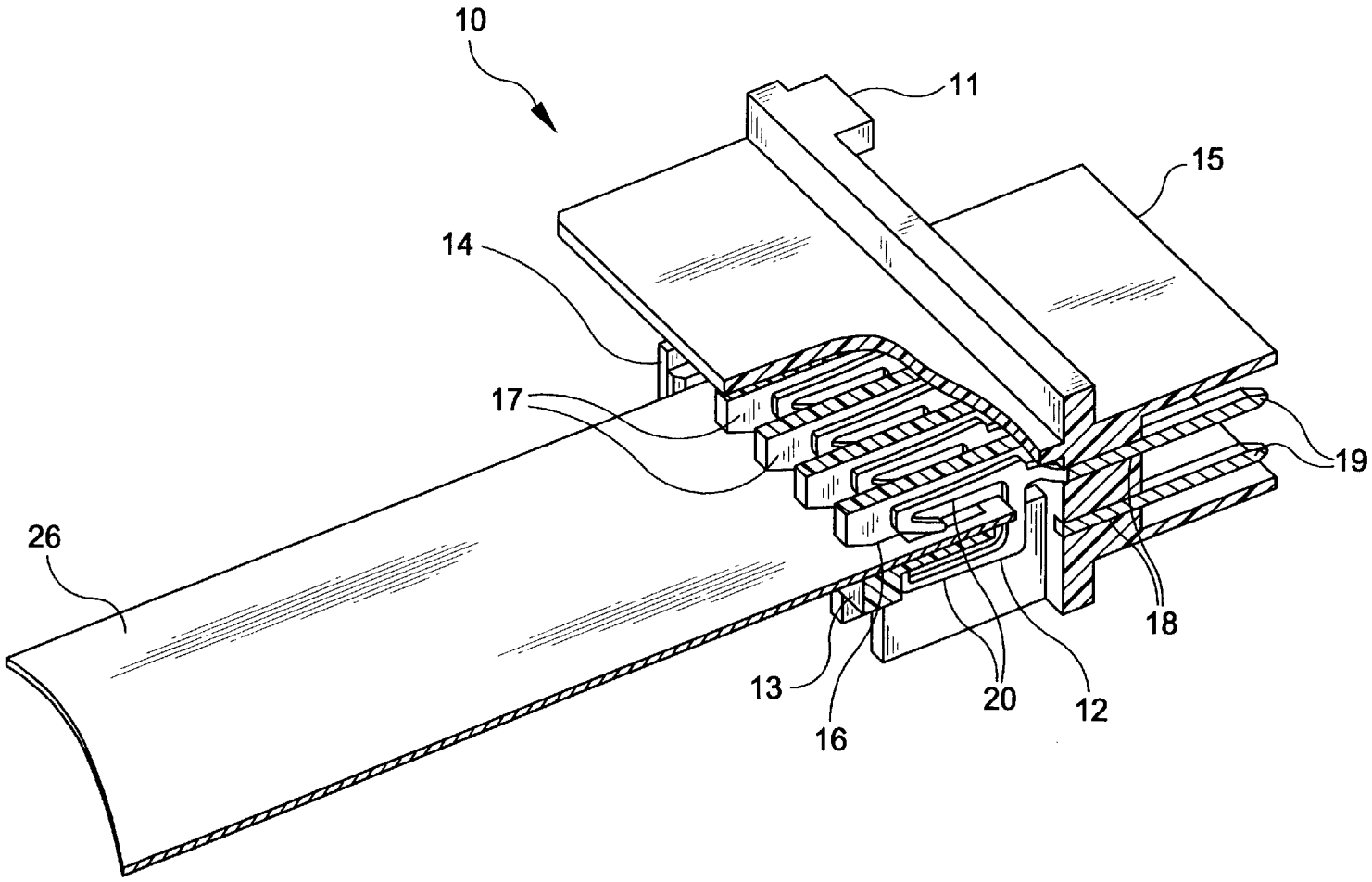
FIG. 3 is a perspective cross-sectional view of the multi-pin connector in the straight configuration according to the present invention.
Figure 4:
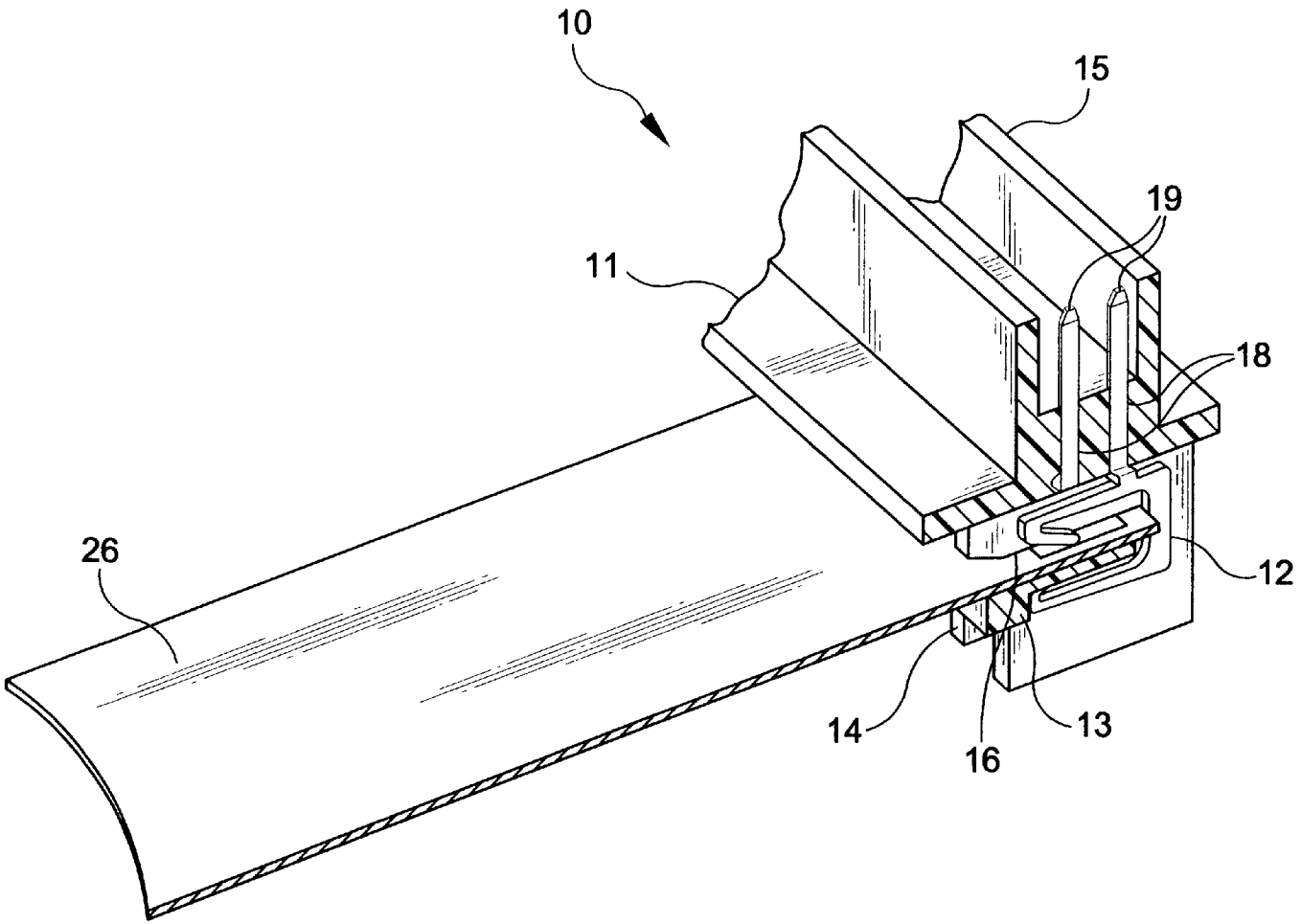
FIG. 4 is a perspective cross-sectional view of the multi-pin connector in the right-angle configuration according to the present invention.

Referring now to FIGS. 2–7, a low insertion force multi-pin connector for a flat flexible cable formed in accordance with the present invention is shown. Multi-pin connector 10 generally includes an elongate insulative housing 11, a plurality of conductive terminals 12 and an insulative slide member 13. The multi-pin connector may be in a straight line configuration as shown in FIGS. 2 and 3 or may be in a right-angle configuration as shown in FIG. 4.

The insulative housing 11 is made of a non-conducting insulative material and is generally rectangular in shape. The housing 11 has a tail side 14, and a header side 15. As shown in FIGS. 2 and 3 the connector 10 may be configured in the straight-line configuration, where the tail side 14 and the header side 15 are on opposite sides of the housing 11. As shown in FIG. 4 the connector 10 may be configured in the right-angle configuration, where the tail side 14 is perpendicular to the header side 15. Extending almost along the entire length of the tail side 14 is a longitudinal slot 16. The width and depth of the slot 16 are sized to receive the slide member 13 and a flexible flat cable as discussed further below. Perpendicularly crossing the longitudinal slot 16 are a series of parallel slits 17. The slits 17 are sized to receive the terminals 12. Extending from the header side 15 of the housing 11 are a series of apertures 18 arranged generally in two parallel rows. Each aperture connects to a respective slit 17 and is sized to frictionally hold a pin portion of a terminal 12.

The terminals 12 are preferably made from a thin electrically conductive metallic material. Each terminal includes a pin portion 19 and two contact arms 20 in a U-shaped configuration. Contact arms 20 include J-shaped portions, the ends of which face inward. The terminals 12 must be made as to permit resilient outward deflection of the contact arms without damaging the terminals.

Figure 5:
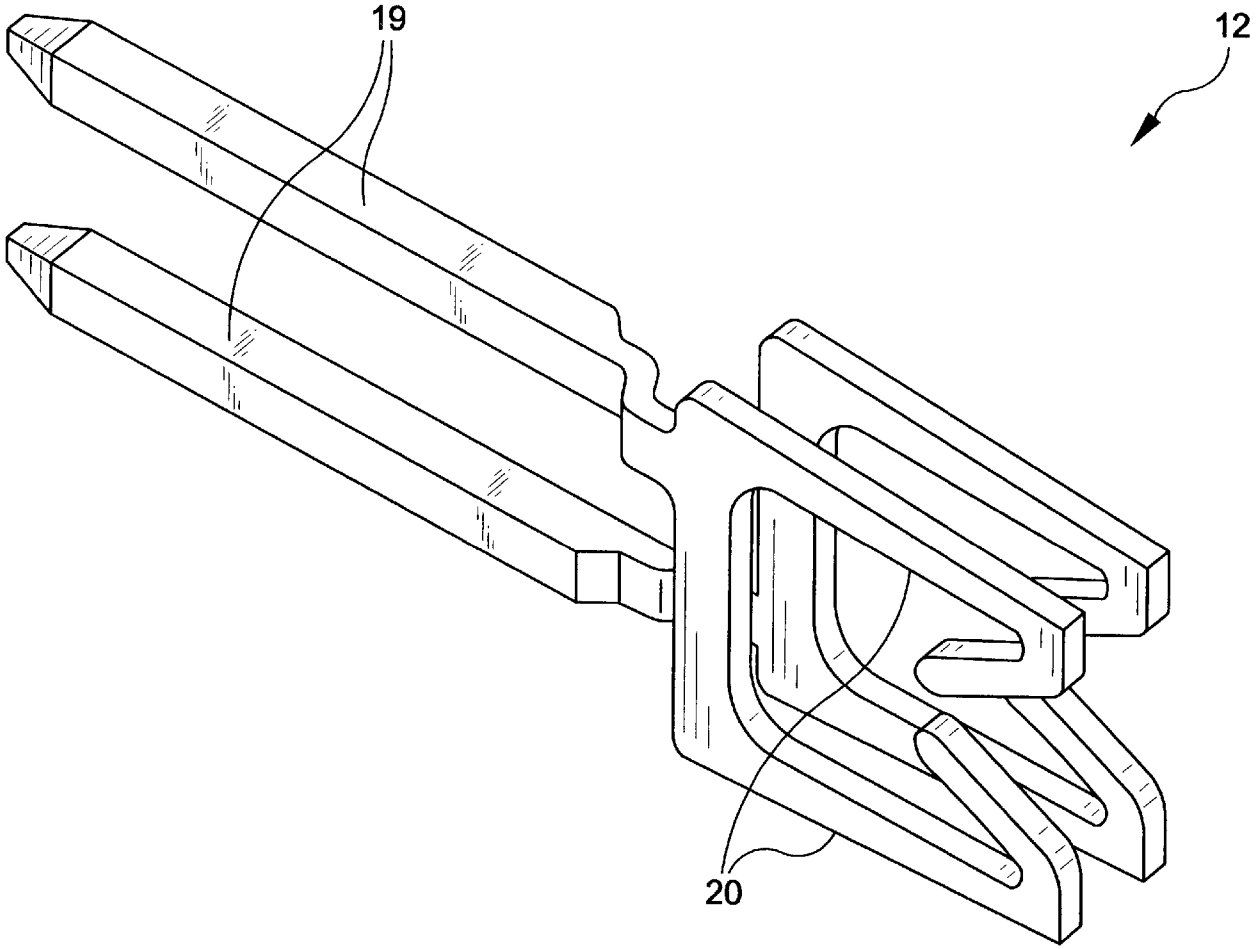
FIG. 5 is a perspective view of the straight configuration terminal according to the present invention.

Referring to FIG. 5, the terminals for a straight-line connector are shaped such that the pin portion 19 extends in an opposite direction as the contact arms 20. Preferably, the pin portion is off center with respect to the contact arms. The straight line connector requires only one shape for the terminals. The terminals 12 are inserted into the terminal slits 17 of the insulative housing 11 from the tail side 14 so that the pin portions 19 are frictionally held by the apertures 18 and protrude through the header side 15. Preferably, the terminals 12 are installed in the terminal slits 17 of the housing 11 in a configuration in which every other terminal is axially rotated 180° with respect to the previous one, thereby defining two rows of laterally staggered pin portions protruding through the header side of the insulative housing as shown in FIGS. 2 and 3.

Figure 6:
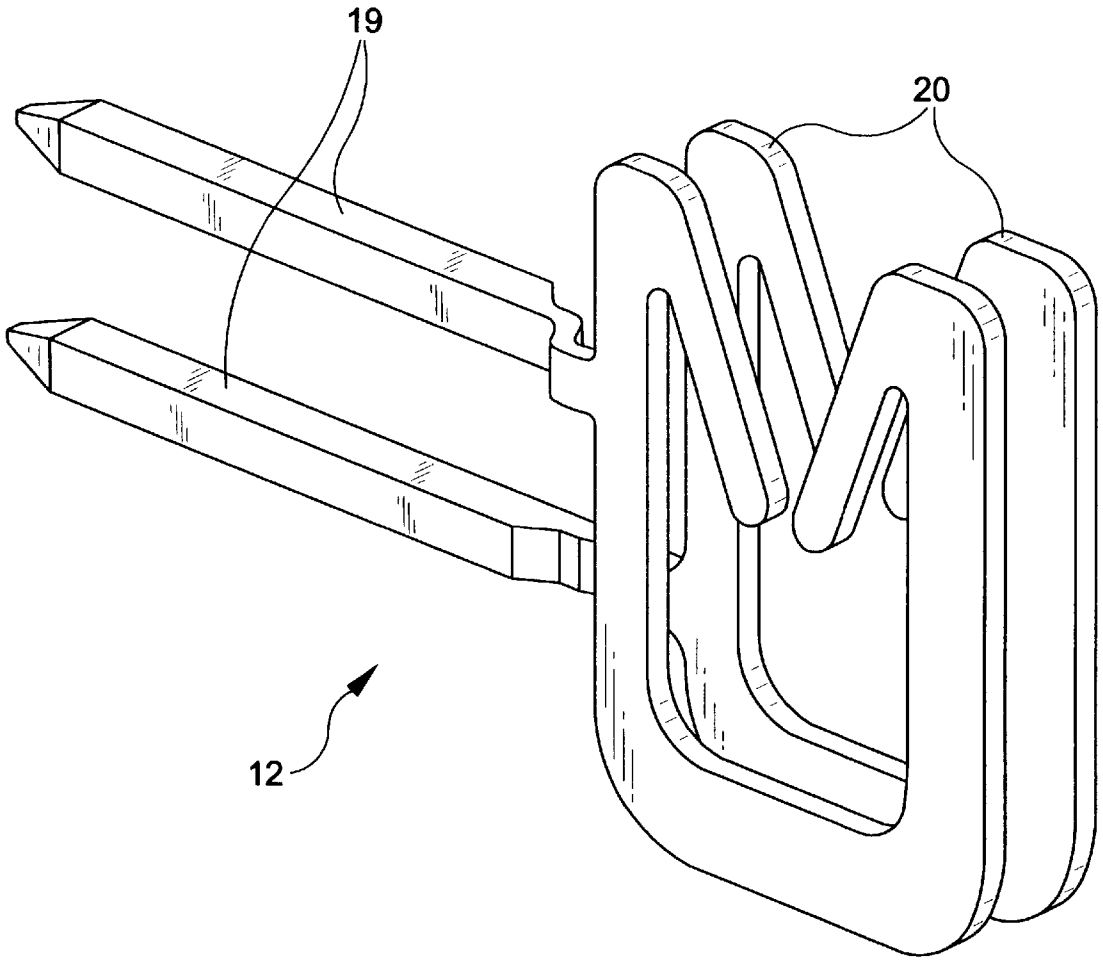
FIG. 6 is a perspective view of the right-angle configuration terminal according to the present invention.
Figure 7:
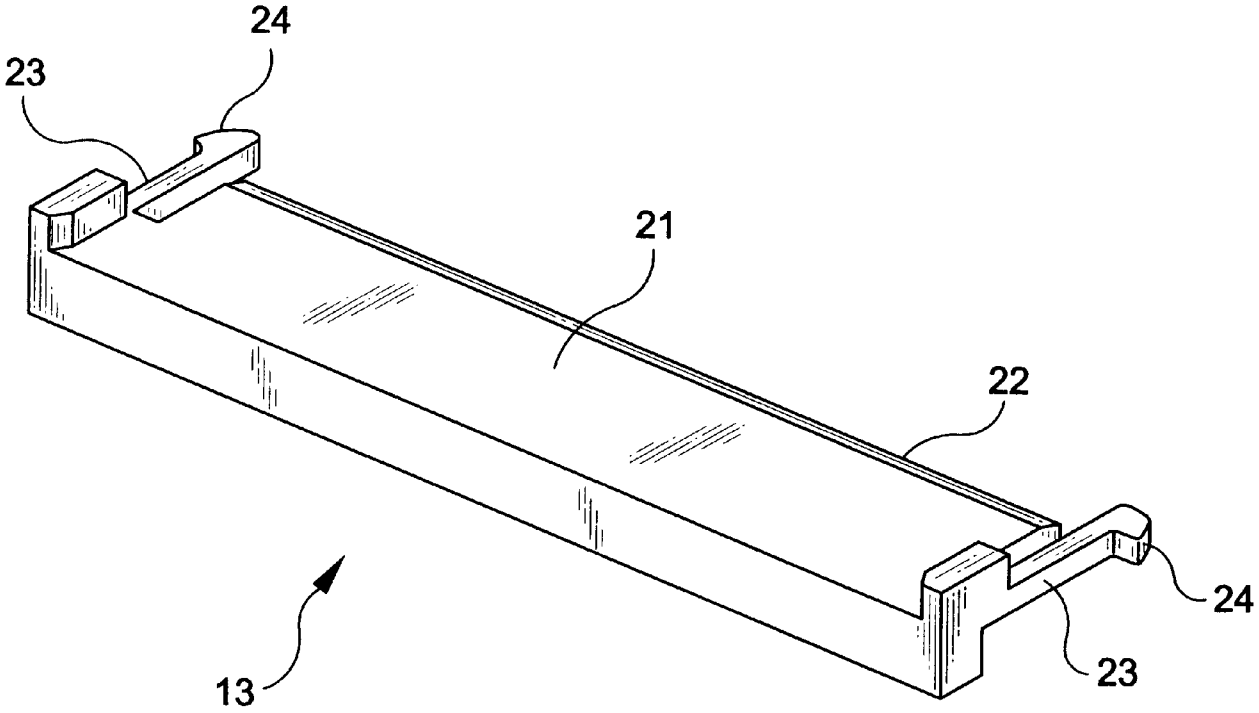
FIG. 7 is a perspective view of the slide member according to the present invention.

For a right-angle connector, the pin portion 19 of the terminal 12 extends perpendicularly to the contact arms 20 as shown in FIG. 6. For a right-angle connector the terminals 12 are preferably provided in two shapes, the first shape having the pin portion extending perpendicularly from an upper location of one of the contact arms and the second shape having the pin portion extending perpendicularly from a lower location of a contact arm. The right-angle terminals are inserted in the housing in alternating shapes to form two rows of pin portions protruding through the header side of the housing as shown in FIG. 4. In either the straight-line or right-angle configuration, the pin portions 19 are preferably offset from the plane of the contact arms 20 such that when installed in the housing the pin portions of two adjacent terminals form a vertical pair. In this manner, the pin portions protruding through the header side of the insulative housing will define a series of parallel vertical pairs.

The slide member 13 is preferably made from the same insulative material as the housing 11. The slide member 13 is roughly the same length as the longitudinal slot 16 and is shaped to be laterally inserted within the slot along with a flat flexible cable. The slide member 13 preferably includes an upper surface 21 having an inclined portion 22 which is adapted to bias the flat cable into contact with the upper row of contact arms as discussed further below. Attached to the sides of the slide member 13 are flexible spring fingers 23 which are capable of slight inward deflection. Each spring finger 23 has a latch projection 24 which cooperatively engages a socket 25 of the insulative housing when the slide member is inserted within the longitudinal slot.

In use, a flat flexible cable 26 having exposed contact pads 27 is first inserted into the longitudinal slot 16 between the rows of contact arms 20 of the terminals 12. The slide member 13 is then inserted between the flat flexible cable 26 and the lower row of contact arms. As the slide member 13 is inserted the inclined portion 22 of the upper surface 21 gently presses the flat cable against the upper row of contact arms making electrical connection between the flat flexible cable and the terminals. The slide member 13 is inserted into the longitudinal slot 16 further until the latch projections 24 engage the sockets 25 of the housing. The spring latch and socket combination releasably retains the slide member within the longitudinal slot of the housing thereby maintaining the flat flexible cable within the connector and against the upper row of contact arms of the terminals. The multi-pin connector 10 is mounted to an external surface of an electrical device such that the header side 15 projects outwardly from the electrical device allowing for external electrical connection to the pin portions of the terminals.

Thus, in accordance with the present invention an internal flat flexible cable of an electrical device is connected to an external port of the device without the need for soldering. The flat flexible cable is quickly and easily connected to the multi-pin connector and may be easily disconnected by releasing the latch of the slide member from the socket of the housing and removing the slide member.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope and spirit of the invention.

What is claimed is:

1. A multi-pin connector for providing an external electrical interface for an internal flat cable of an electrical device, the flat cable having exposed conductive portions along a single surface thereof, said connector comprising:

an elongate insulative housing having a tail side, a header side and a longitudinal slot disposed on said tail side;

a plurality of conductive terminals each comprising a pin portion and two contact arms in a U-shaped configuration so as to define a pair of generally parallel legs each being capable of being deflectable outwardly, each of said terminals further including a pair of J-leads inwardly extending from said parallel legs, each terminal being mounted within the insulative housing forming generally parallel rows of upper and lower contact arts on said tail side with said pin portions protruding through said header side; and an insulative slide member shaped to be laterally inserted within said longitudinal slot along with the flat cable, wherein the flat cable is inserted in said longitudinal slot between said upper and lower rows of contact arms and said slide member is inserted in said longitudinal slot between the flat cable and one of said rows and elastically presses the exposed conductive portions of the single surface of the flat cable against the J-leads of the other of said rows making internal electrical connection between the conductive portions and said terminals and wherein said connector is mounted to the electrical device such that said header side projects outwardly from an external surface of the electrical device to provide external electrical connection to said pin portions;

wherein said slide member includes a deflectable spring latch integrally formed therewith and said housing includes a latch receiving socket for releasably engaging said latch for releasably retaining said slide member within said housing, said release of said latch from said socket providing for disconnection of said flat cable from said terminals.

2. The multi-pin connector as defined in claim 1 wherein the insulative housing further comprises a plurality of slits and apertures, said slits being disposed on the tail side and arranged perpendicularly across the slot and said apertures extending from the header side, each aperture in communication with a respective slit, and wherein the conductive terminals are mounted within said respective slits of the insulative housing forming generally parallel rows of upper and lower contact arms on the tail side with the pin portions protruding through said apertures of the header side.

3. The multi-pin connector as defined in claim 1 wherein each terminal is shaped such that the contact arms extend in an opposite direction as the pin portion and wherein the header side and the tail side of the insulative housing are generally parallel with respect to each other forming a straight electrical connection between said header side and said tail side.

4. The multi-pin connector as defined in claim 3 wherein the terminals are installed within the insulative housing in a configuration in which every other terminal is axially rotated 180°, with respect to the previous one, which defines two rows of pin portions protruding through the header side of the insulative housing.

5. The multi-pin connector as defined in claim 4 wherein the pin portion of each terminal is laterally offset from the plane of the contact arms.

6. The multi-pin connector as defined in claim 1 wherein each terminal is shaped such that the pin portion extends perpendicularly to the contact arms and wherein the header side and the tail side of the insulative housing are generally perpendicular with respect to each other forming a right-angle electrical connection between said header side and said tail side.

7. The multi-pin connector as defined in claim 1 wherein each terminal is shaped in one of two configurations, the first configuration having the pin portion extending perpendicularly from the contact arms at an upper location and the second configuration having the pin portion extending from the contact arms at a lower location and wherein said terminals are installed within the insulative housing in alternating configurations, which defines two rows of pin portions protruding through the header side of the insulative housing.

8. The multi-pin connector as defined in claim 7 wherein the pin portion of each terminal is laterally offset from the plane of the contact arms.

9. The multi-pin connector as defined in claim 1 wherein the contact arms of each terminal include J-shaped portions at the ends thereof, the ends of said J-shaped portions facing inwardly between the contact arms.

10. The multi-pin connector as defined in claim 1 wherein the slide member includes an upper surface having an inclined surface portion adapted to bias the flat cable into contact with one of the rows of contact arms when the flat cable and slide member are inserted in the longitudinal slot of the insulative housing.

* * * * *